United States Patent [19]

Simons

[11] Patent Number: 5,049,420

[45] Date of Patent: Sep. 17, 1991

[54] PROCESS FOR APPLYING MICROCAPSULE-CONTAINING COMPOSITIONS TO PAPER

[75] Inventor: Terence J. Simons, Chinnor, England

[73] Assignee: The Wiggins Teape Group Limited, Basingstoke, England

[21] Appl. No.: 483,827

[22] Filed: Feb. 23, 1990

[30] Foreign Application Priority Data

Feb. 23, 1989 [GB] United Kingdom ..... 8904112

[51] Int. Cl.[5] ..... B05D 3/12

[52] U.S. Cl. ..... 427/361; 427/359; 427/365; 427/428

[58] Field of Search ..... 427/361, 362, 364, 365, 427/359, 428

[56] References Cited

U.S. PATENT DOCUMENTS

| | | | |
|---|---|---|---|
| 2,398,844 | 4/1946 | Muggleton et al. | 427/428 |
| 3,186,861 | 6/1965 | Smith et al. | 428/321.5 |
| 3,684,561 | 8/1972 | Labombarde | 427/428 |
| 3,830,199 | 8/1974 | Saito et al. | 427/428 |
| 4,198,446 | 4/1980 | Goetz | 427/150 |

FOREIGN PATENT DOCUMENTS

| | | |
|---|---|---|
| 0037682 | 10/1981 | European Pat. Off. . |
| 974497 | 11/1964 | United Kingdom . |
| 1151690 | 5/1969 | United Kingdom . |
| 1253721 | 11/1971 | United Kingdom . |
| 1433165 | 4/1976 | United Kingdom . |
| 1460201 | 12/1976 | United Kingdom . |

OTHER PUBLICATIONS

*Coating Equipment and Processes,* George L. Booth, 1970, pp. 168–169.

"The Dahlgren Liquid Application System (LAS)", M. Bridges, Paper Industry Technical Association Conference held Oct. 1983, pp. 123–141.

"The Combined Locks Wet End Coating Process", J. F. Whalen, 1965, *TAPPI Monograph,* pp. 9–13.

"Reverse Roll Coating", G. L. Booth, *TAPPI Monograph,* pp. 69–73.

"Roll Coating", *Pulp & Paper,* 3rd Edition, vol. 4, Casey, pp. 2137–2147.

"Capabilities of the Dahlgren Liquid Application System", Dahlgren Mft. Co., 1981.

*Primary Examiner*—Michael Lusignan

*Assistant Examiner*—Diana L. Dudash

*Attorney, Agent, or Firm*—Burns, Doane, Swecker & Mathis

[57] ABSTRACT

Microcapsules are applied in metered quantity to a paper web passing through an ingoing nip between a hard applicator roll and a soft backing roll. Metering is achieved by means of a deformable metering roll in adjustable pressure contact with the applicator roll and rotating in an opposite sense thereto to define an ingoing nip. Coating composition is fed to this nip from a pipe or by the roll dipping into a bath of coating composition. The metered coating emerging from the metering nip is re-distributed and smoothed by a deformable smoothing roll rotating in the same sense as the applicator roll and in contact therewith. The process facilitates application of relatively high solids microcapsule compositions at low wet coatweights.

11 Claims, 2 Drawing Sheets

PROCESS FOR APPLYING MICROCAPSULE-CONTAINING COMPOSITIONS TO PAPER

BACKGROUND OF THE INVENTION

This invention relates to a process for applying a microcapsule-containing coating composition to paper. The process is particularly useful for applying microcapsule coatings as used in pressure-sensitive copying paper, or carbonless copying paper as it is more usually referred to.

Carbonless copying paper sets typically comprise an upper sheet coated on its lower surface with microcapsules containing a solution in an oil solvent of at least one chromogenic material (alternatively termed a colour former) and a lower sheet coated on its upper surface with a colour developer composition. If more than one copy is required, one or more intermediate sheets are provided, each of which is coated on its lower surface with microcapsules and on its upper surface with colour developer composition. Imaging pressure exerted on the sheets by writing, typing or impact printing (e.g. dot matrix or daisy-wheel printing) ruptures the microcapsules thereby releasing or transferring chromogenic material solution on to the colour developer composition and giving rise to a chemical reaction which develops the colour of the chromogenic material and so produces a copy image.

In an alternative type of carbonless copying paper, the microcapsules and the colour developer are applied to the same surface of the paper, either in a single layer or in two separate layers.

Various techniques have been used for applying the microcapsule coatings required in carbonless copying papers. The technique used originally involved applying an excess of an aqueous microcapsule coating composition to the paper by means of an applicator roll, and then metering the wet coating to the desired coatweight by means of an air knife. The paper web was guided so as to kiss or contact the upper part of the applicator roll, with the lower part of the roll dipping into a bath of coating composition. The applicator roll was continuously rotated such that its surface in contact with the web moved in the same direction as the moving web (forward-roll coating). Such an arrangement is disclosed, for example, in British Patent No. 974497.

A modified form of roll/air knife coating was later introduced, and is disclosed for example in British Patent No. 1151690. In this arrangement, a rotating pick-up roll dips into a bath of coating composition and is arranged to transfer the picked up coating to an applicator roll running in contact with the paper web. A metering roll positioned at a precise spacing from the applicator roll is provided to meter off excess coating composition transferred from the pick-up roll. The spacing of the metering roll from the applicator roll is termed the metering gap, and the width of this gap is the primary determinant of the thickness, and hence the wet coatweight, of the applied coating. Fine adjustment of wet coatweight can be achieved by adjustment of the applicator roll speed relative to the web speed (adjustment of the metering roll speed to suit the applicator roll speed may also be necessary). As disclosed in British Patent No. 1151690, the pick-up roll may rotate in either the same or the opposite sense as the applicator roll. The metering roll always rotates in the same sense as the applicator roll (so that their adjacent surfaces at the metering gap move in opposite directions). The web runs counter to the direction of movement of the applicator roll surface at the point of contact of the web and the applicator roll (reverse-roll coating). An air-knife is provided for final metering to the desired coatweight.

Gravure coating (also termed "flexographic" coating) has also been widely used for applying microcapsule coatings, particularly for "on machine" coating, i.e. coating the web immediately after it has been produced on the papermachine, with no intermediate reel-up and transport to a separate coating machine. Such a technique is disclosed, for example, in British Patent No. 1253721. A further proposal for gravure application of microcapsule coatings is to be found in European Patent Application No. 37682 A.

Gravure coating is particularly suited to the application of coatings at a low wet coatweight. This means that gravure coating can only be successfully used in the production of carbonless copying papers when high solids content microcapsule coating compositions are to be applied. By "high solids" in this context is meant microcapsule coating compositions of a solids content of the order of around 40% or more, and of which the microcapsules have synthetic polymer walls rather than the more traditional gelatin coacervate walls. Not all manufacturers of pressure-sensitive copying papers are able or wish to use such high solids microcapsule coating compositions. Gravure coating also has other drawbacks which for some manufacturers outweigh its advantages, and in any case the cost of converting from non-gravure coating to gravure coating can be high.

A further microcapsule coating process which is said to be in commercial use relies on the use of a Dahlgren LAS coater. This utilises a resilient roll which dips into a bath of coating composition and also runs in nip pressure contact with a hard steel applicator roll. The resilient roll and the applicator roll rotate in opposite senses so that their surfaces run in the same direction at the nip between them. The resilient roll serves both to pick up coating composition from the bath and to meter a desired amount of the coating on to the surface of the applicator roll. The applicator roll also runs in nip pressure contact with a resilient backing roll, with the paper web running between the applicator roll and the backing roll in a direction counter to the direction of movement of the surface of the applicator roll with which it is in contact, i.e. in a reverse-roll coating mode. This means that the film split pattern produced at the metering nip between the resilient roll and the applicator roll should not be a major problem, as reverse roll coating should smooth out such a pattern.

Thus at the present time, there is no universally employed technique for applying microcapsule coatings in the production of carbonless copying paper. Non-gravure roll coating techniques based on those disclosed in British Patent No. 1151690 remain in widespread use. A number of modifications have however been made or proposed in relation to the process and apparatus disclosed in British Patent No. 1151690. For example, advances in metering roll technology have made it possible to meter very precisely the coatweight applied to the paper by the applicator roll, and thereby to dispense with the need for secondary metering by means of an air knife.

British Patent No. 1460201 proposes feeding the microcapsule coating composition direct to the metering nip of a coater working on the principles disclosed in British Patent No. 1151690. This dispenses with the need for a separate pick-up roll. British Patent No. 1460201 also discloses that the applicator roll may if desired be rotated in a sense such that its surface moves in the same direction as the web at the point of contact of the web and the applicator roll, rather than running counter to the web as disclosed in British Patent No. 1151690. This constitutes a change from reverse roll coating to forward roll coating. A three-roll coating head for forward roll application of microcapsule coatings is also disclosed in FIG. 7 of British Patent No. 1433165.

Forward roll coating has the advantage that it presents less problems of web tension control and runnability at high coating speeds than does reverse roll coating. On the other hand, forward roll coating has the drawback that film splitting occurs as the web parts company with the applicator roll, with the result that the wet coating on the web exhibits an uneven film-split pattern. This problem can be countered by the provision of reverse-turning smoothing rolls positioned downstream of the coating head. Such rolls are known in themselves, and are disclosed, for example, in British Patent No. 974497 referred to above (this patent also discloses a forward roll coating process which gives rise to a film-split pattern). The action of the smoothing rolls is to redistribute the wet coating on the web and so erase the film-split pattern. The smoothing rolls do not have a metering action, i.e. they do not remove coating composition from the web. Although beneficial in terms of producing an improved coating pattern, the use of smoothing rolls is disadvantageous in that it makes control of the web tension both more difficult and more critical than if no smoothing rolls are employed.

Whilst microcapsule-coating techniques based on the metering roll coating process disclosed in British Patent No. 1151690 have proved themselves over the years, metering gap techniques are inherently limited in relation to the minimum wet coatweight which may be applied. This is because the wet coatweight is determined primarily by the width of the metering gap, as explained earlier. The width of this gap varies slightly as the rolls rotate, owing to inevitable imperfections in the roll bearings, and in the "roundness" of the rolls. Thermal expansion of the rolls can also affect the width of the metering gap. In most cases, variations arising for the reasons just mentioned are insignificant in relation to the width of the gap, but as the coatweight diminishes, this ceases to be so. Thus attempts to apply very low coatweights using metering gap technology are likely to result in a coating of uneven thickness. There is also a risk that the metering and applicator rolls could touch. Since these rolls are conventionally of steel, contact of the rolls at high speeds would almost certainly result in serious damage.

In the past, the low coatweight limitation of metering gap coating has not been a problem in the case of microcapsule coatings, since the wet coatweights needed have been above the wet coatweight threshold at which problems of the kind outlined above become significant. However, advances in microencapsulation technology are making it possible to obtain higher solids content microcapsule coating compositions, not only in the case of microcapsules having synthetic polymer walls, but also in the case of gelatin-based microcapsules. These higher solids content microcapsule compositions require the application of a lower wet coatweight to achieve the same dry coatweight and are advantageous in two respects. Firstly, less water has to be evaporated off in the drying stage, which saves energy. Secondly, a better sheet appearance results since the paper is not wetted to the same extent (less wetting of the paper reduces the tendency of the finished paper to curl and to cockle).

Metering gap coating processes appear to be inherently unlikely to be capable of meeting the likely long term future needs for the application of high solids content microcapsule coating compositions, because of the low wet coatweight limitations discussed above. But quite apart from the limitations associated with the metering gap itself, currently known metering gap coating technology has other limitations when considered in relation to higher solids content microcapule coating compositions. Firstly, the higher viscosity of such compositions inhibits proper transfer of the microcapsule coating from the applicator roll to the web as the web passes over the applicator roll. Secondly, the wet coatweights applied when higher solids coating compositions are used are so low that reverse-turning smoothing rolls would not be fully effective to smooth out the film split pattern inevitably produced with forward roll coating. This could not simply be remedied by operating in a reverse-roll mode, as reverse roll coating is unsuited to very high coating speeds. This is because it becomes very difficult to control the web tension properly, which leads to inconsistent coating and web breakages.

A further factor is that for a given wet coatweight, reverse roll coating generally requires a smaller metering gap than does forward-roll coating. This is because in reverse roll coating, the applicator roll speed has to be equal to or greater than web speed in order to give a uniform distribution of coating composition, whereas for forward roll coating, the applicator roll runs at a fraction of the web speed. The speed of the applicator roll relative to the web speed affects the coatweight applied, and therefore the faster running applicator roll used in reverse roll coating will apply a higher coatweight at a given web speed and metering gap. Thus in order to obtain a particular coatweight, a lower metering roll gap is needed in the case of reverse roll coating. The inherent metering gap limitations therefore bear more harshly on reverse-roll coating than on forward roll coating.

It is an object of the present invention to overcome or at least minimise the problems described above and to provide an improved high speed forward roll coating process for applying microcapsule-containing coating compositions to paper. The present invention also seeks to provide a process which can be taken up at a relatively low conversion cost by a paper mill which currently uses non-gravure roll coating for applying microcapsule coating compositions and which wishes to avoid the risk of switching to a fundamentally different type of coating process, for example a gravure coating process or the Dahlgren process, of which it has no experience.

The present invention achieves the above objectives by dispensing with metering gap metering and instead controlling coatweight by means of a metering roll which is deformable rather than hard and which rotates in pressure contact with the applicator roll. A deformable smoothing roll is also provided to run in contact with the applicator roll to smooth the metered coating, and a soft backing roll is provided at the point of contact of the applicator roll and the web so as to afford good transfer of the coating from the applicator roll to the web without significant film splitting. This dispenses with the need for smoothing rolls positioned downstream of the coating head.

The use of a rubber-covered smoothing roll in contact with a steel applicator roll was in fact first proposed over 40 years ago in U.S. Pat. No. 2398844. This patent issued on 23rd Apr. 1946 to Gerald D. Muggleton and Albert F. Piepenberg, and was assigned to Combined Locks Paper Co. The coater forming the subject of this patent became well known as the Combined Locks coater, and is referred to in a number of standard reference books, for example "Coating Equipment & Processes" by George L. Booth; Tappi Monograph No. 28 entitled "Pigment Coating Processes"; and "Pulp and Paper", by James P. Casey. The Combined Locks pigment coater design has thereby been given wide exposure. Despite this, it has not previously been appreciated that the problems described above in relation to the application of microcapsule containing coating compositions can be avoided by a process which, inter alia, utilises a deformable smoothing roll running in contact with a hard applicator roll.

According to the invention, there is provided a process for applying a microcapsule-containing coating composition to paper, comprising the steps of feeding coating composition to a region of contact between a hard applicator roll and a deformable metering roll which rotate in opposite senses such that their surfaces at the region of contact move in the same direction and define an ingoing nip;

maintaining gentle pressure between the applicator and metering rolls and controlling their relative speeds so as to permit only a controlled amount of coating composition to pass through said nip and to leave a metered amount of coating composition on the surface of the applicator roll after it has left said region of contact;

smoothing the metered amount of coating composition remaining on the surface of the applicator roll by means of a deformable smoothing roll which rotates in the same sense as the applicator roll and in contact therewith; and transferring the smoothed coating composition on the surface of the applicator roll to a paper web which runs in the same direction as, and no slower than, the surface of the applicator roll carrying the smoothed coating composition and which is held in temporary contact with the applicator roll by a soft backing roll which rotates in an opposite sense to the applicator roll so as to form an ingoing nip therewith.

The applicator roll surface preferably runs at least about 75 to 80% of the web speed, and may approach web speed. The optimum ratio between the applicator roll speed and the web speed may vary somewhat, depending on the web speed. By way of example, an applicator roll surface speed of about 990 to 995 m $min^{-1}$ (i.e. 99 to 99.5% of web speed) has been found to be advantageous for a web running at about 1000 m $min^{-1}$. The optimum relative web and applicator roll surface speeds will also depend on other factors as well, particularly the viscosity of the microcapsule composition being applied.

Although the present invention is particularly suited to the application of high solids content high viscosity microcapsule compositions, it may of course also be used for the application of lower solids content lower viscosity microcapsule compositions.

In order to enable the invention to be more readily understood, reference will now be made to the accompanying drawings which depict diagrammatically and by way of example an embodiment thereof and data relevant thereto, and in which:

DESCRIPTION OF THE PREFERRED EMBODIMENT

Figure 1:
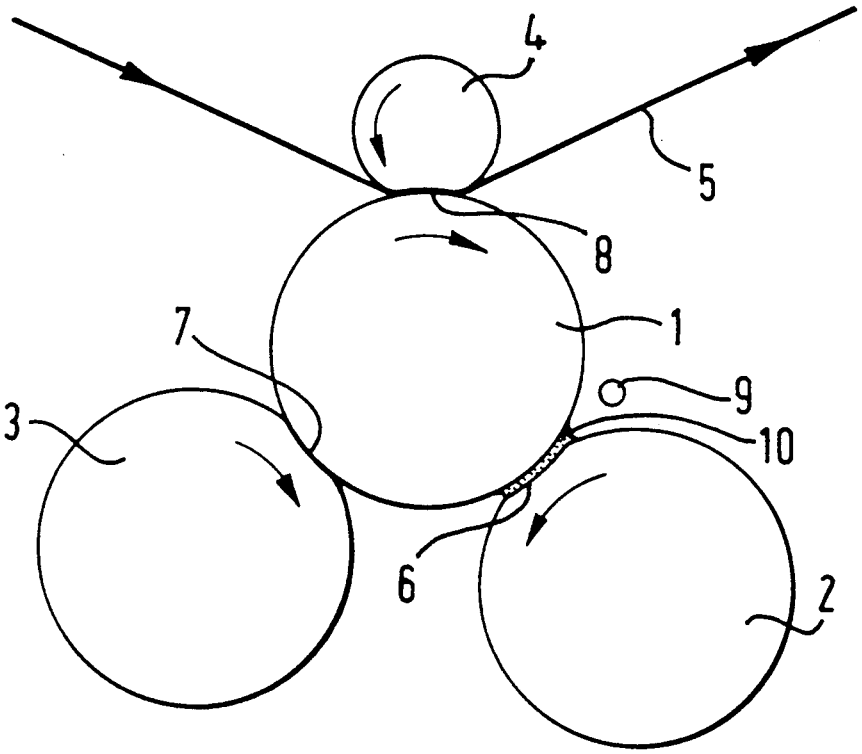
FIG. 1 is a diagrammatic side view (not to scale) of a coating station for continuously applying a microcapsule composition to a paper web.

Referring first to FIG. 1, a coating head comprises a hard chrome steel applicator roll 1 in contact with a deformable metering roll 2, a deformable smoothing roll 3, and a soft backing roll 4. A paper web 5 passes between the applicator roll 1 and the backing roll 4 in the direction shown by the arrows. The rolls 2, 3 and 4 are made deformable or soft by the provision of rubber coverings, for example nitrile rubber coverings. Typical hardnesses for the rubber covering are 30° to 60° Shore A for the metering roll, 60° Shore A for the smoothing roll, and 35° Shore A for the backing roll. These hardness values are not thought to be limiting, and optimum values for a particular coating operation can be determined without difficulty by routine trial procedures. Determination of Shore hardness values, including Shore A hardness values, is described in British Standard No. 2782 available from the British Standards Institution, London.

The metering roll 2 is urged against the applicator roll 1 with pressure, and the rubber covering of the metering roll thereby deforms such that there is a nip region 6 of finite width where the metering roll 2 bears against the applicator roll 1. Strictly speaking, the applicator and metering rolls are not in contact, in use, since they are separated by a thin film of coating composition, which "lubricates" the contact. The rubber covering of the smoothing roll 3 likewise deforms where it bears against the applicator roll 1 and a nip region 7 of finite width results. Similarly, the soft rubber covering of the backing roll 4 deforms where it bears against the applicator roll 1, and a nip region 8 of finite width results. In this instance, the paper web 5 is interposed, in use, between the applicator roll 1 and the backing roll 4. The regions 6, 7 and 8 will hereafter be referred to simply as nips 6, 7 and 8, despite their finite widths. It should be noted that the extent of the deformation and the length of the nip has been exaggerated on the drawing for ease of understanding.

The rolls 1 to 4 are arranged to rotate in the direction shown by the arrows in FIG. 1. More particularly, the applicator roll 1 is arranged to rotate such that its surface in contact with the web 5 moves in the same direction as the web 5. As drawn, the rotation of the applicator roll 1 is clockwise. The backing roll 4 rotates in an opposite sense to the applicator roll, i.e. anti-clockwise, such that the surfaces of the applicator roll and the backing roll move in the same direction at the nip 8. The nip 8 is therefore an ingoing nip. The metering roll rotates in an opposite sense to the applicator roll, i.e. anti-clockwise, so that the contacting surfaces of the applicator and metering rolls move in the same direction at the nip 6. The nip is therefore an ingoing nip. The smoothing roll 3 rotates in the same sense as the applicator roll 1, so that the surfaces of the applicator and smoothing rolls move in opposite directions at the nip 7.

An inlet pipe 9 is provided for supplying coating composition to the nip 6. The coating composition collects as a small puddle 10. The manner of supply of the coating composition to the nip 6 is not critical, and instead of the arrangement shown, the metering roll 2 could dip into a bath of coating composition and function as a pick-up roll as well as a metering roll.

In operation, coating composition from the puddle 10 passes in controlled fashion through the nip 6. The amount of coating composition passing through the nip is determined primarily by two factors, namely the pressure at the nip and the relative speeds of the applicator and metering rolls. The pressure at the nip is itself influenced by two factors, namely the force with which the metering roll is urged against the applicator roll, and the hardness of the rubber covering on the metering roll, which influences the cushioning effect of the rubber covering. The surfaces of the applicator and metering rolls diverge as they leave the nip 6, and the film of coating composition which has passed through the nip is forced to split, i.e. some of the coating composition is retained on the applicator roll and the remainder on the metering roll. This gives rise to an uneven "film-split" pattern of the kind well-known in the paper coating art.

The amount of coating composition retained on the applicator roll remains constant, provided the nip pressure and the relative speeds of the metering and applicator rolls are unchanged, i.e. it is a metered amount. This amount can of course be varied by altering the nip pressure or the relative speeds of the metering and applicator rolls.

Rotation of the applicator roll brings the coating composition, still with its film-split pattern, to the nip 7 between the smoothing roll and the applicator roll. The action of the smoothing roll, the surface of which moves counter to the direction of movement of the coating composition on the applicator roll surface, is to remove the coating composition from the surface of the applicator roll and carry it round until it again contacts the applicator roll surface at the opposite side of the nip 7. The applicator roll surface at this point runs counter to the smoothing roll surface carrying the coating composition and so removes the coating composition from the surface of the smoothing roll. The double transfer of the coating composition, i.e. from the applicator roll surface to the smoothing roll surface and then back again smooths out the uneven film split pattern and leaves an even film of coating composition on the applicator roll surface. The smoothing roll does not have a metering action, i.e. it does not remove excess coating composition, but merely redistributes and smooths the coating already on the surface of the applicator roll.

The smoothed film of coating composition is then carried round towards the nip 8. The applicator roll surface moves at a slower speed than the paper web 5, and so the web "wipes" the coating composition off the surface of the applicator roll. The applicator roll 1 presses against the soft backing roll, the surface of which is preferably arranged to travel at web speed, and this facilitates substantially complete transfer of the coating composition to the web without the formation of a film-split pattern as the web and the applicator roll surface diverge after leaving the nip 8. The transfer of the coating composition by pressure of the applicator roll against the soft backing roll can be regarded as akin to that which occurs with an impression roll in a printing operation.

Cleaning doctor blades (not shown) may be arranged to scrape the edges of the applicator roll so as to control the coating deckle.

Water sprays may be provided at the edges of the backing roll to minimise wear on the roll caused by the edge of the paper web.

The roll speeds, nip pressures and other factors required to obtain optimum coating performance depend on the speed at which the web is to be coated, on the characteristics of the coating composition being applied, particularly its solids content or viscosity, and on the wet coatweight which is to be applied. A typical set of operating and other parameters is given by way of example below:

- Web type: lightweight coating base (c.49 g $m^{-2}$) as conventionally used in carbonless copying paper.
- Web speed: 1000 m $min^{-1}$
- Coating composition: 32% solids content aqueous suspension of microcapsules plus conventional starch binder (microcapsules derived by gelatin coacervation technique). Viscosity of composition typically in the range of from 150 to 300 cps (Brookfield, Spindle No. 2, 100 r.p.m, 22° C. ±1° C.)
- Target coatweight: 2.5 g $m^{-2}$ (dry)
- Applicator roll
  - surface: chrome steel
  - speed of surface: 995 m $min^{-1}$
- Metering roll
  - surface: nitrile rubber of 30° to 60° Shore A hardness
  - speed of surface: 20 m $min^{-1}$
- Smoothing Roll
  - surface: nitrile rubber of 60° Shore A hardness
  - speed of surface: 1025 m $min^{-1}$
- Backing Roll
  - surface: nitrile rubber of 35° Shore A hardness
  - speed of surface: 1000 m $min^{-1}$ (i.e. web speed)
- Nip width of applicator roll with
  - metering roll: 27 mm
  - smoothing roll: 7 mm
  - backing roll: 4 mm (as measured prior to feeding web through nip)

In general, the hardness of the rubber coverings on the metering and smoothing rolls can be regarded as affording a means of coarse adjustment of coatweight and coating pattern, whereas nip pressure and nip width adjustments afford a means of fine tuning.

The invention will now be illustrated by the following Examples:

EXAMPLE 1

This illustrates the use of the present process for coating 49 g $m^{-2}$ carbonless base paper at a high web coating speed (1000 m $min^{-1}$) with a range of different applicator roll/metering roll nip widths.

The microcapsule coating composition applied had a solids content of 32% and a viscosity of 200 cps (Brookfield RVT viscometer, Spindle No. 2, 100 r.p.m., 22° C.), and was formulated as follows (prior to the addition of sufficient dilution water to produce a 32% solids content):

| | Parts (dry) | Solids Content (%) |
|---|---|---|
| Emulsion | 100 | 32.6 |

-continued

| | Parts (dry) | Solids Content (%) |
|---|---|---|
| Wheatstarch (particulate) | 13.8 | 85.4 |
| Ground cellulose fibre floc | 14.0 | 91.0 |
| Carboxymethylcellulose | 8.3 | 15.0 |
| Starch binder | 9.6 | 30.0 |

The coating head was as described with reference to the drawing, and the operating parameters were as specified in the passage immediately preceding this Example, except that four different applicator roll/metering roll nip widths were used, namely 27, 28, 29 and 30 mm. The metering roll covering had a hardness of 60° Shore A. It was found that there was an approximately linear relationship between nip width and coatweight applied:

| Nip Width (mm) | Dry Coatweight (g $m^{-2}$) |
|---|---|
| 27 | 2.6 |
| 28 | 2.1 |
| 29 | 2.0 |
| 30 | 1.8 |

EXAMPLE 2

This illustrates the use of the present process for coating 49 g $m^{-2}$ carbonless base paper at a high web coating speed (1000 m $min^{-1}$) using a metering roll having a nitrile rubber covering of 30° Shore A (i.e. softer than that used in Example 1), a range of different applicator roll speeds and smoothing roll speeds, and two different applicator roll/metering roll nip widths, namely 37 mm and 44 mm.

The microcapsule coating composition and the remaining operating parameters were as in Example 1.

Figure 2:
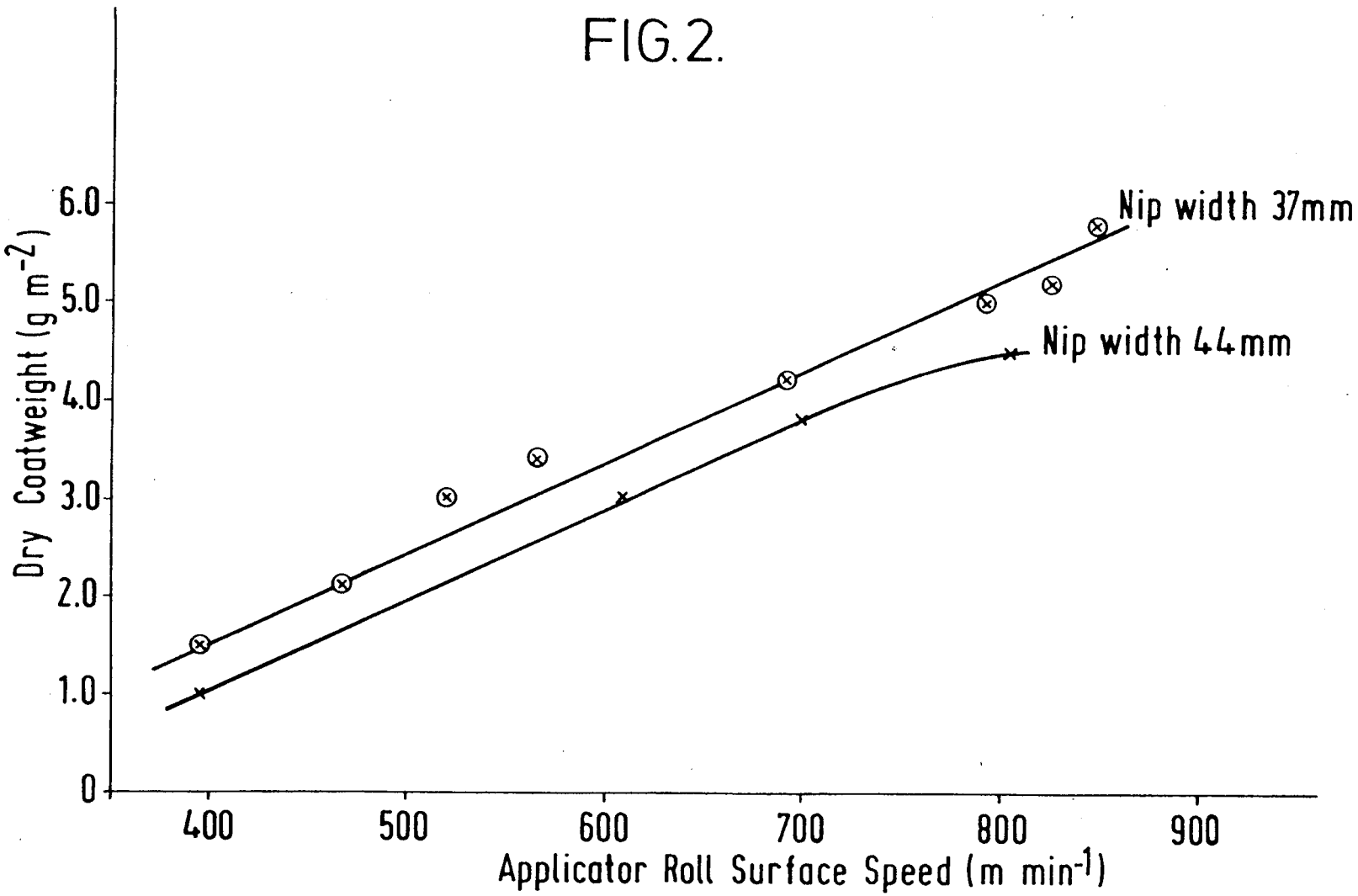
FIG. 2 is a graph to be referred to in more detail hereafter.

Variation of the applicator roll speeds in relation to a fixed web speed produced, as would be expected, an approximately linear effect on the coatweight applied, for each of the two nip widths. Use of the higher nip width (44 mm) resulted in a lower coatweight being applied than was applied with the lower nip width, as can be seen from the following data when depicted graphically in FIG. 2:

| Nip Width (mm) | Applicator Roll Surface Speed (m $min^{-1}$) | Dry Coatweight (g $m^{-2}$) | Smoothing Roll Surface Speed (m $min^{-1}$) |
|---|---|---|---|
| 44 | 394 | 1.0 | 420 |
| | 608 | 3.0 | 629 |
| | 700 | 3.8 | 728 |
| | 804 | 4.5 | 828 |
| 37 | 396 | 1.5 | 881 |
| | 467 | 2.1 | 880 |
| | 519 | 3.0 | 879 |
| | 564 | 3.4 | 879 |
| | 691 | 4.2 | 876 |
| | 792 | 5.0 | 876 |
| | 824 | 5.2 | 842 |
| | 848 | 5.8 | 875 |

EXAMPLE 3

This illustrates the use of the present process for coating 49 g $m^{-2}$ carbonless base paper at a range of web speeds up to 1000 m $min^{-1}$. The applicator roll surface speed was kept at a constant 395 m $min^{-1}$, the smoothing roll surface speed was 420 m $min^{-1}$, and the applicator roll/metering roll nip width was 37 mm. The other operating parameters were as in Example 2, and the microcapsule coating composition was as in Examples 1 and 2.

As would be expected, it was found that the coatweight applied was in approximately linear relationship to the web speed:

| Web Speed (m $min^{-1}$) | Dry Coatweight (g $m^{-2}$) |
|---|---|
| 600 | 3.0 |
| 700 | 2.5 |
| 800 | 1.7 |
| 900 | 1.3 |
| 1000 | 1.1 |

EXAMPLE 4

This illustrates the use of additional applicator roll/metering roll nip widths and a lower web speed (400 m $min^{-1}$). The applicator and smoothing roll speeds were kept constant at 395 and 420 m $min^{-1}$ respectively. The paper and microcapsule coating composition used were as in the previous Examples, and the other operating parameters were as in Example 3.

It was found that increasing the applicator roll/metering roll nip width decreased the coatweight applied in approximately linear fashion:

| Nip Width (mm) | Dry Coatweight (g $m^{-2}$) |
|---|---|
| 33 | 5.5 |
| 34 | 5.1 |
| 35 | 4.8 |
| 36 | 4.0 |
| 37 | 3.3 |

EXAMPLE 5

This illustrates the use of the present process with a range of applicator roll/metering roll nip widths and a lower solids content microcapsule coating composition (24% instead of 32%). The microcapsule coating composition was otherwise as in Example 1. The web speed was 400 m $min^{-1}$. The coating composition had a viscosity of 100 cps (Contraves Rheomat 108 Viscometer, 24° C.).

The paper used and the other operating parameters were as in Example 3.

As with Example 4, it was found that increasing the applicator roll/metering roll nip width decreased the coatweight applied in approximately linear fashion:

| Nip Width (mm) | Dry Coatweight (g $m^{-2}$) |
|---|---|
| 16 | 5.9 |
| 20 | 4.5 |
| 22 | 4.0 |
| 24 | 3.6 |

EXAMPLE 6

This illustrates the use of the present process using the same microcapsule composition, paper and web speed as in Example 5, but at a range of applicator roll speeds. The applicator roll/metering roll nip width was kept constant at 24 mm, and the smoothing roll speed was kept constant at 420 m $min^{-1}$.

It was found, as would be expected, that the coatweight applied increased approximately linearly with the increase in applicator roll speed:

| Applicator Roll Surface Speed (m $min^{-1}$) | Dry Coatweight (g $m^{-2}$) |
|---|---|
| 394 | 4.0 |
| 384 | 3.8 |
| 367 | 3.6 |
| 339 | 3.3 |
| 316 | 2.9 |

I claim:

1. A process for applying a microcapsule-containing coating composition to a continuous paper web, comprising the steps of feeding a microcapsule-containing coating composition to a region of contact between a hard applicator roll and a deformable metering roll, where the applicator and metering rolls rotate in opposite senses such that their surfaces at the region of contact move in the same direction and define an ingoing nip;

controlling the pressure between, and the relative speeds of rotation of, the applicator and metering rolls so as to permit only a controlled amount of coating composition to pass through said nip and to leave a metered amount of coating composition on the surface of the applicator roll after it has left said region of contact;

smoothing the metered amount of coating composition remaining on the surface of the applicator roll by means of a deformable smoothing roll which rotates in the same sense as the applicator roll and in contact therewith; and transferring the smoothed coating composition on the surface of the applicator roll to a dry continuous paper web which runs in the same direction as, and no slower than, the surface of the applicator roll carrying the smoothed coating composition and which is held in temporary contact with the applicator roll by a soft backing roll which rotates in an opposite sense to the applicator roll so as to form another ingoing nip therewith.

2. A process as claim 1, wherein the speed of the applicator roll surface is at least 75% of the web speed.

3. A process as claimed in claim 2, wherein the speed of the applicator roll surface is at least 99% of web speed.

4. A process as claimed in claim 1 wherein the metering roll is deformable and has a Shore A surface hardness of from about 30° to about 60°.

5. A process as claimed in claim 1 wherein the smoothing roll is deformable and has a Shore A surface hardness of about 60°.

6. A process as claimed in claim 1 wherein the backing roll is deformable and has a Shore A hardness of about 35°.

7. A process as claimed in claim 3 wherein the smoothing roll surface speed is slightly faster than the web speed, and the backing roll surface speed is about the same as the web speed.

8. The process of claim 1 including the step of advancing the web through the ingoing nip between the applicator roll and the soft backing roll at a speed of at least 600 m $min^{-1}$.

9. The process of claim 1 including the step of advancing the web through the ingoing nip between the applicator roll and the soft backing roll at a speed of at least 1,000 m $min^{-1}$.

10. The process of claim 1 wherein the smoothing step only occurs before the transferring step.

11. The process of claim 1 wherein the smoothing step includes redistribution of the coating composition by:

removing the coating composition from the surface of the applicator roll with the deformable smoothing roll; and transferring the coating composition from the deformable smoothing roll to the applicator roll surface.

* * * * *